United States Patent [19]

Ledewitz

[11] Patent Number: 4,493,439

[45] Date of Patent: Jan. 15, 1985

[54] COLLAPSIBLE DISPENSING CONTAINER

[76] Inventor: William Ledewitz, 31 Brookwood Dr., Woodbridge, Conn. 06525

[21] Appl. No.: 568,281

[22] Filed: Jan. 4, 1984

Related U.S. Application Data

[63] Continuation-in-part of Ser. No. 284,826, Jul. 20, 1981, abandoned, which is a continuation-in-part of Ser. No. 208,663, Nov. 20, 1980, abandoned.

[51] Int. Cl.[3] ..... B65D 35/10

[52] U.S. Cl. ..... 222/94; 222/92; 222/107

[58] Field of Search ..... 222/92, 94, 107, 105, 222/566, 569

[56] References Cited

U.S. PATENT DOCUMENTS

| | | | |
|---|---|---|---|
| 1,188,115 | 6/1916 | Thompson | 222/107 |
| 2,258,395 | 10/1941 | Tome | 222/107 |
| 2,332,414 | 10/1943 | Tome | 222/92 |
| 2,386,498 | 10/1945 | Ostrander | 222/107 |
| 3,260,411 | 7/1966 | Dobson | 222/107 |
| 3,724,722 | 4/1973 | Ballo | 222/105 |

FOREIGN PATENT DOCUMENTS

| | | | |
|---|---|---|---|
| 295349 | 2/1968 | Australia | 222/107 |
| 869291 | 1/1942 | France | 222/92 |
| 529433 | 6/1955 | Italy | 222/107 |
| 347400 | 4/1931 | United Kingdom | 222/107 |
| 561620 | 5/1944 | United Kingdom | 222/92 |
| 1327803 | 8/1973 | United Kingdom | 222/92 |

*Primary Examiner*—Charles A. Marmor
*Attorney, Agent, or Firm*—Alfred E. Miller

[57] ABSTRACT

A collapsible dispensing container provided with a conical-shaped head portion having a central opening and a multi-laminate tubular body. One end of the tubular body is folded over and defines an annular space between the folded over part and the upstanding wall part of the tubular body. A disc-like barrier member is provided with a peripheral flange that is located in the annular space and heat sealed to adjacent parts of the tubular body. The tubular bodies are formed with a slight taper for nesting, resulting in ease of handling and shipping.

3 Claims, 10 Drawing Figures

Fig. 1.
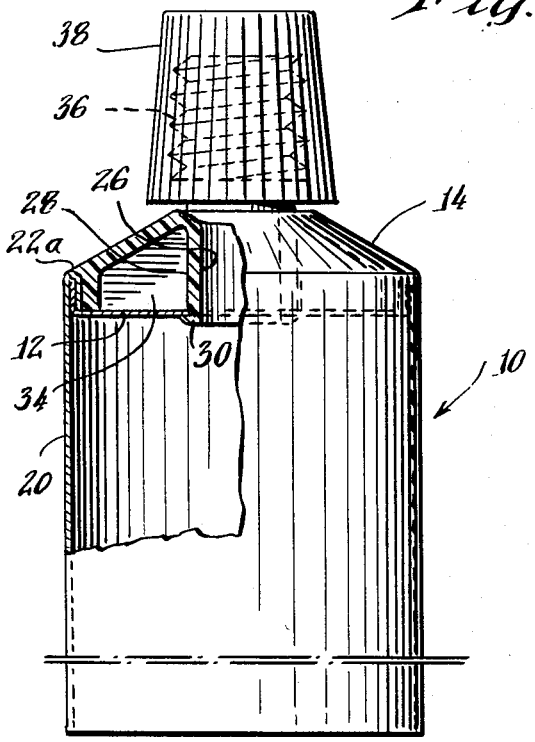
Fig. 4.
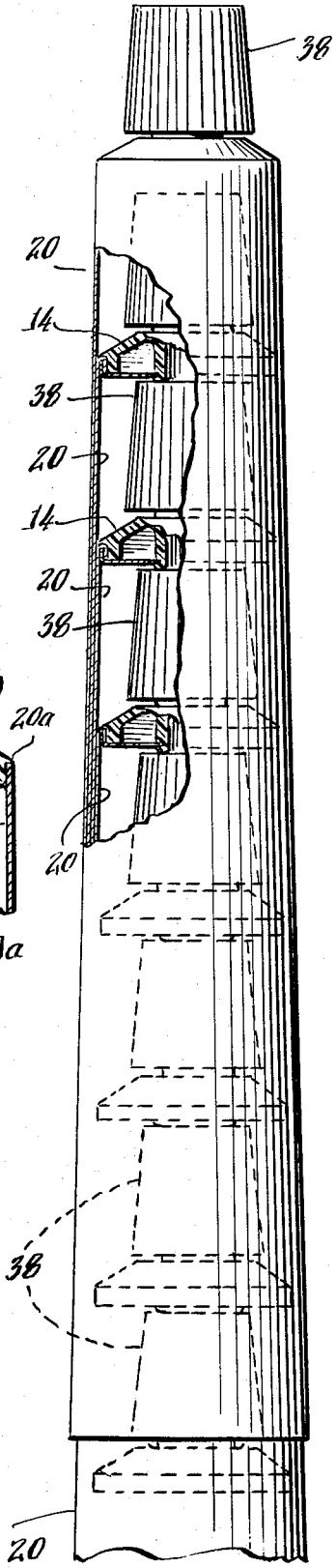
Fig. 5.
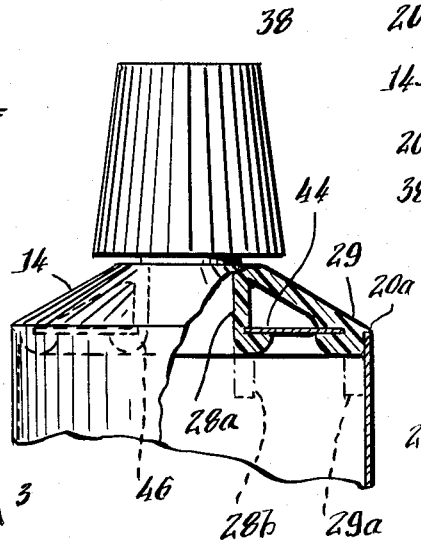
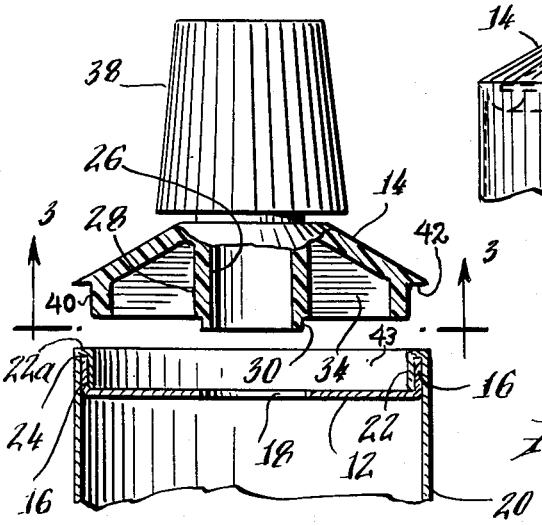
Fig. 2.
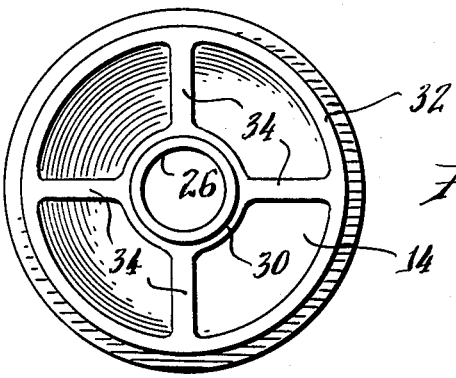
Fig. 3.

COLLAPSIBLE DISPENSING CONTAINER

This application is a continuation-in-part of application Ser. No. 284,826, filed July 20, 1981 now abandoned, which is a continuation-in-part of application Ser. No. 208,663, filed Nov. 20, 1980, now abandoned.

The present invention relates to a collapsible container in which toothpaste, shaving cream, and other types of viscous substances are dispensed from. The container is typically in the form of an elongated tube which can be squeezed in order to eject the contents therefrom.

It is important to insure that the contents of the tube are not penetrated by atmospheric air from the exterior thereof, and to additionally insure that the tube contents do not migrate through the walls of the tube to the atmosphere. The tubular body of the dispensing container is constituted of a multi-ply laminate having an aluminum foil layer that is generally coated with inner and out plies of plastic, such as polyethylene, thereby forming an excellent oxygen and moisture barrier to prevent flavor loss and product deterioration. Examples of such a construction are shown in U.S. Pat. No. 3,295,725 to Brandt and U.S. Pat. No. 3,307,738 to Scheindel.

In the past, the loss of flavor and product deterioration in the head portion of the collapsible tube was prevented by the means of a barrier in the form of a urea or polyester funnel-shaped insert that was inserted in the interior of the head portion of the collapsible tube, such as shown in U.S. Pat. No. 4,011,968 to McGhee et al. Thus, the funnel-shaped insert and the funnel-shaped head of the collapsible tube were complementary. However, this arrangement was found to be too costly an complicated to manufacture, and due to a moisture absorption caused expansion and resultant stress cracking of the outer material thereof.

It is an object of the present invention to provide a barrier member fabricated of a laminate of plastic and aluminum foil having a circular flange on its outer periphery which is inserted in the space created by 180° turnover of the upper end of the longitudinal tube. The flange and the upper end of the longitudinal tube are then heat sealed together to form a diaphragm in which no moisture absorption will occur, thus preventing permeation into the shoulder area of the tube.

It is a further object of the present invention to fuse all exposed laminate edges of the tube with polyethylene to thereby prevent adverse chemical reaction.

It is a further object of the present invention to provide a neck portion on said tube head which is upset or peened over the inner exposed edges of said diaphragm, thereby providing protection against adverse chemical reaction.

It is a further object of the present invention to construct collapsible tubes which have a taper of approximately 1° so that tubes can be nested for handling and shipping. In addition, the present unique packaging permits the use of considerably less storage space in warehousing the present products. Furthermore, this arrangement allows for automation of assembly lines for packing for shipment, as well as for filling the dispensing containers at the customers' plant. The nesting of the tubular dispensers in rod-like packages prevents the entrance of foreign substances within the tubes to create contamination therein. Moreover, these rod-like packages, when assembled, are rigid, and therefore reduce deformation during handling in transport of the dispensing containers.

Yet another object of the present invention is the provision of reinforcing ribs in the head portion of the collapsible tube to prevent the collapsing of the head portion when the tube is squeezed at various locations. In addition, the ribs act as a support for the barrier member, which is a laminated disc.

It is another object of the present invention to provide a collapsible tube constituting a dispensing container which is provided with a head and neck portion in which the neck has a relatively thick wall to deter permeation, the lower free end of which is upset or peened over against the underside of a diaphragm laminate barrier in the form of a punched out web of material comprising a round disc with a center hole. The head portion is provided with sloping sides, the lower free ends of which are also upset or peened over against the underside of said diaphragm barrier. The foregoing construction results in an inexpensive barrier member that can be easily inserted within the head and neck portion of the collapsible tube, and in which the exposed ends of the barrier are covered by the upset portions of the neck and head of the collapsible tube, respectively.

It is another object of the present invention to provide a diaphragm barrier member in the form of a flat disk, while the reinforcing ribs are located between the barrier member and the interior of the head portion, but below the neck of said tube.

It is a further object of the present invention to provide a tubular or cylindrical collapsible squeeze tube which is fabricated from prelaminated sheet material and thermally sealed and flowed along the interior and exterior seams thereof, thus forming an unbroken seal of polyethylene along the exposed edges.

In order that the invention will be more clearly understood, it will now be disclosed in greater detail with reference to the accompanying drawings, in which:

FIG. 1 is a front elevation view, partly in section, of the collapsible container constructed in accordance with the teachings of the present invention.

FIG. 2 is a partial side elevation view of the structure shown in FIG. 1, before the head portion thereof is secured to said cylindrical body.

FIG. 3 is a cross-sectional view taken along the lines 3—3 of FIG. 2.

FIG. 4 shows a plurality of collapsible containers, each having a 1° taper on the sides of said collapsible tubes so that the same may be stacked for ease of handling and shipping, etc.

FIG. 5 is another embodiment of the present invention using an annular, disk-like diaphragm barrier whereby the shoulder and neck portion of the elongated tube are upset or peened over the rear surface of said disk-like barrier member, and heat sealed to said member.

Figure 6:
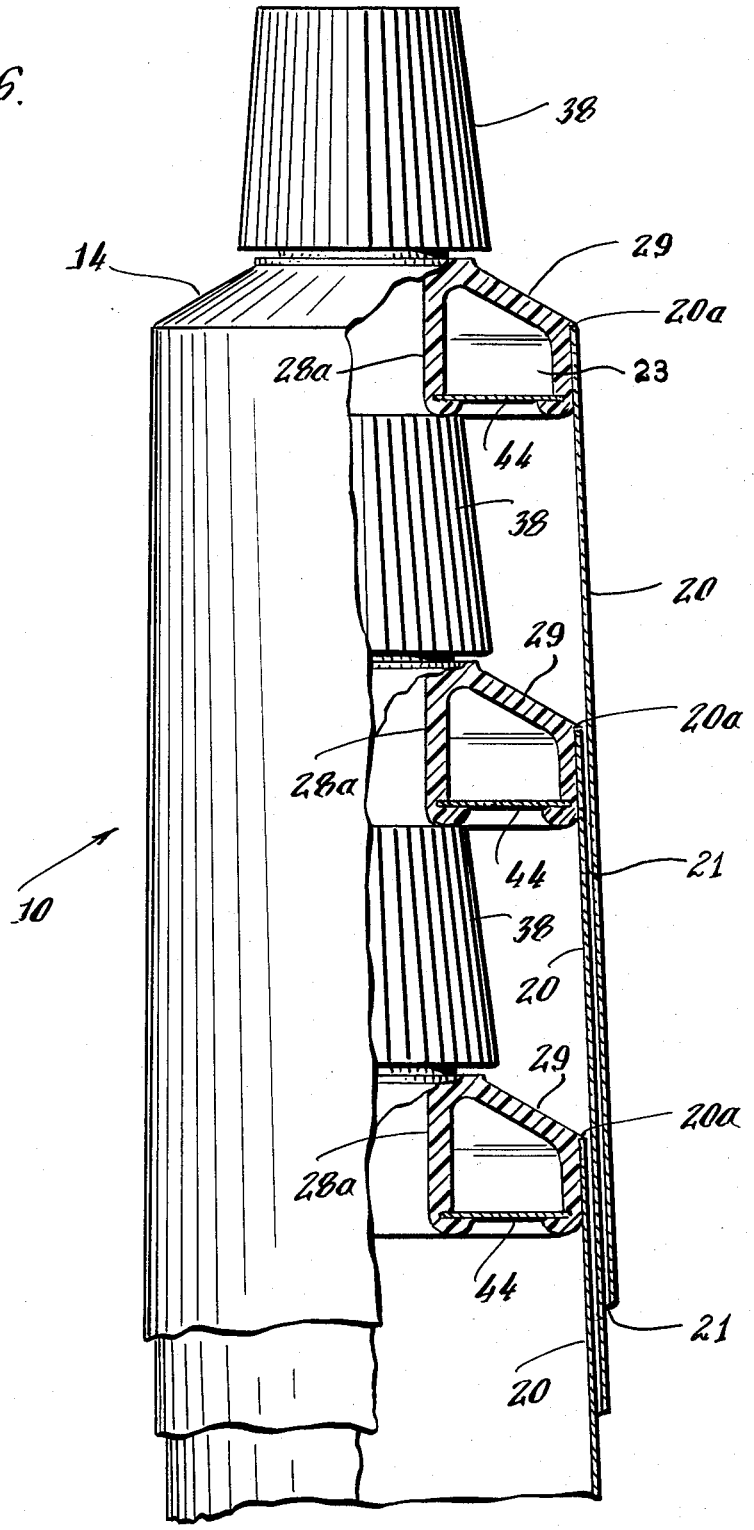
FIG. 6 is an enlarged cross-sectional view of the plurality of collapsible containers shown in FIG. 4.

Referring to FIGS. 1–3, a collapsible tube, such as a toothpaste or similar dispensing container is referred to generally by the numeral 10 which is produced from a prelaminated sheet material that is thermally sealed along the interior and exterior seams thereof. The multiple ply laminate is of the known type in which the metal foil is coated with inner and outer plies of plastic, such as polyethylene (not shown). This laminate forms an excellent oxygen and moisture barrier to prevent loss of flavor and product deterioration. However, the loss of flavor and oxygen penetration in the head portion of the tube is a problem that is somewhat relieved by the insertion of a urea or polyester, funnel-shaped insert having a polyethylene covering, which is known as a barrier member. The use of such an insert is both costly and sometimes ineffective due to moisture absorption which causes expansion and consequently results in the cracking of the outer material thereof. In order to overcome the above objections, a barrier member 12 is shown in FIG. 2 before it is assembled to the dispensing head portion 14 of the collapsible tube. The barrier member 12 is provided with an annular peripheral flange 16 and a hole 18. The tubular body 20 has its upper end 22 folded over approximately 180° to form a space 24 therebetween. Subsequently, the side wall of the tubular member 20 is heat sealed with the turnover portion 22, as well as the annular flange 16 of the barrier member 12. This arrangement prevents permeation of moisture in the shoulder area and head portion of the collapsible tube.

The head portion 14 is provided with a central opening 26, as well as a neck portion 28, the latter of which passes through aperture 18, and is upset or peened over the exposed edges in the opening 18 of the barrier member, thus sealing the same against chemical action from the product within the container. The peening or upsetting of the end 30 of the neck 28 can be accomplished by the use of heat and pressure, such as a hot rotary tool, or sonic welding, induction heating, or any other suitable method for fusing the end 30 about the exposed edges of the opening 18 in the barrier member 12.

The collapsible tube head portion is further provided with an annular reinforcing member 32 having ribs 34, as shown in FIG. 3, and which is inserted between the barrier member 12 and the inner surface of top portion 14. This structure functions to strengthen the top portion 14 of the collapsible tube 10 which, of course, is not squeezable like the elongated tubular member 20, as well as preventing the tube shoulder from warping. In addition, the ribs 34 act as a support for the barrier member laminate 12. The neck portion 28 has a threaded extension 36 directed away from the tubular body 20, and which is adapted to receive a screw threaded cap 28. As seen in FIG. 2, the head portion 14 is provided with an annular downturned flange 40, and a triangular-shaped lateral projection 42 so that when the neck portion 14 is assembled to the tubular body portion 20 by heat sealing the flange 40 fits tightly within the recess 43, with the outer edges thereof tightly engaging the adjacent surface of the folded over flange 22. Moreover, the triangular projection 42 rests on top of the connecting part **22*a* of the folded over flange. Thereafter, the tubular body portion 20 and the folded over end 22 thereof together with the annular flange 16 of the barrier member and the downturned flange 40, as well as the lateral projection 42, are all thermally sealed together to form a tight connection, as seen in FIG. 1, which prevents oxygen and water vapor transmission from entering the tube 10**.

Referring to FIG. 4, a series of open bottom collapsible tubes 10 are shown in a nested condition. The nesting of the tubes 10 is made possible since elongated tubular bodies 20 are each tapered about 1° to their vertical axes. It should be evident that this configuration results in space saving relative to shipping and handling. Furthermore, the bottom ends of the stacked and tapered tubes are not exposed to dust and other contamination, with the exception of the lowermost tube which can be covered in a sanitary fashion. In order to prevent jamming when nesting dispensing containers, caps are secured to the screw threaded neck portions of each tubular body, and the containers with caps are nested. In this manner, the individual containers can be easily and rapidly pulled apart or disassembled. FIG. 6 shows an enlarged view of the nested collapsible tubes 10.

It should be evident that the head and neck construction of the container can be incorporated with the tapered tubular bodies as seen in FIG. 4.

FIG. 5 shows another embodiment of the present invention in which a laminated disc 44 formed of a punched-out web of material that is generally circular in shape, and has a central opening 46. The disc is inserted in the neck portion 14. The laminated tube body 20 is provided with a top **20*a* extending also vertically, and which is adapted to be heat sealed to the head portion 14. The latter is provided with a neck rib portion 28*a*, as well as a shoulder rib portion 29, both of which have respective rib extensions 28*b* and 29*a*, as shown in dotted lines in FIG. 5. The extensions 28*a* and 29*a* are peened over or upset onto the undersurface of diaphragm 44, as shown in full lines therein. The neck portion 28*a* of the embodiment shown in FIG. 5 has a certain thickness in order to overcome the possible permeation therethrough due to the lack of a barrier member in the neck area. It should be noted that the neck rib 28*a* extends vertically and substantially parallel to the longitudinal axis of the tube body 20, while the shoulder rib 29 extends at an obtuse angle relative to the rib 28*a* thereby forming a space 23 therebetween and located above the disc 44**.

It should also be evident that the distance between the top of the cap of the peened over extensions **28*a* and 29*a* is critical since each nesting succeeding collapsible tube with their caps 38 in place are so spaced vertically when nested to form a gap 21** between adjacent tube bodies of approximately 0.011 inches. The provision of this gap has the desirable result that there will be no scoring of the outside surface of each relatively soft plastic laminate tube by following tube when nested. Furthermore, modern filling technology of collapsible tubes, for example for toothpaste, has brought the filling speed up to 400 units per minute. Obviously, rapid denesting is a necessity, and therefore the provision of a gap of approximately 0.011 inches permits a fast separating of the nested tubes in order to satisfy modern filling line needs.

Consequently, the alternate construction shown in FIG. 5 results in a configuration that effectively prevents oxygen and water vapor transmission from penetrating into the tubular body 20.

Figure 7:
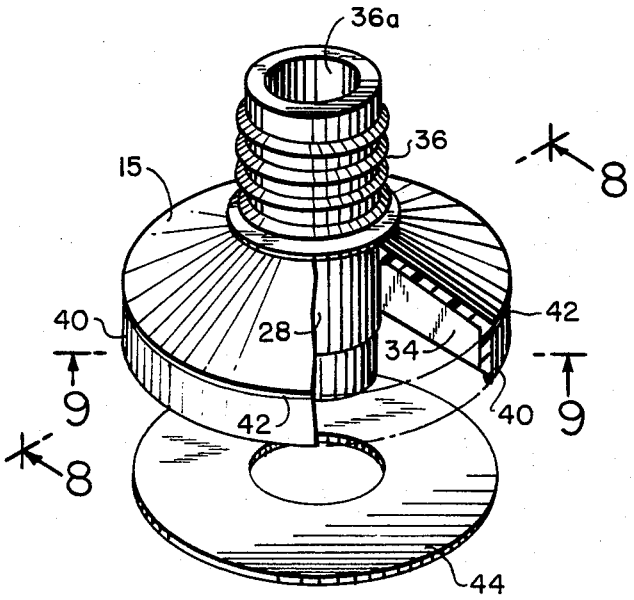
FIG. 7 is an exploded elevational view of the top part of another embodiment of the collapsible container.
Figure 8:
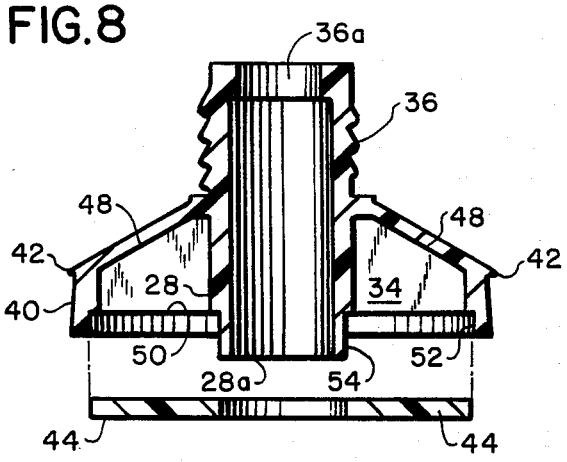
FIG. 8 is a sectional view taken along the lines 8—8 of FIG. 7.
Figure 9:
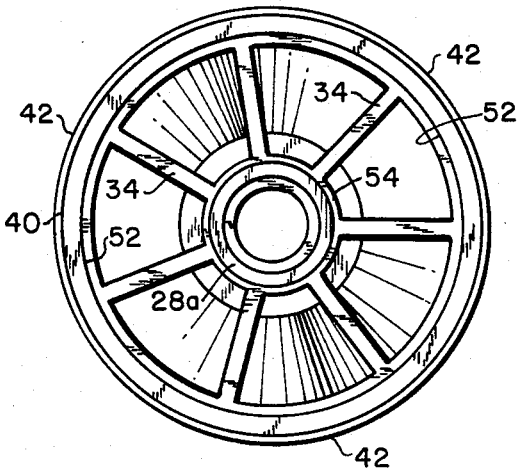
FIG. 9 is a bottom plan view along the lines 9—9 of FIG. 7, with the disc removed.
Figure 10:
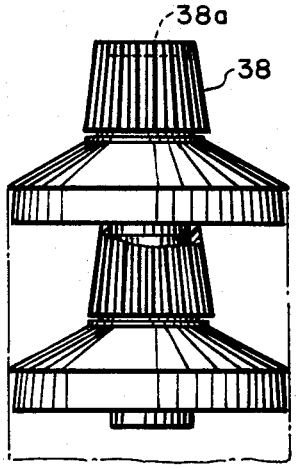
FIG. 10 is a side elevation view of the head portions of collapsible tubes in a stacked, superposed relationship.

A further embodiment of the present invention is shown in FIGS. 7–9 which is similar in construction to the embodiment shown in FIGS. 2 and 5 in that the collapsible tube head portion has a neck 28 having a threaded extension 36 directed away from the tubular body, and which is adapted to receive a screw threaded cap 38, as seen in FIG. 10. The head portion is further provided with a shoulder part 15 and an annular down-turned flange 40, as well as a triangular-shaped lateral projection 42 so that when the head is assembled to the tubular body portion, the flange 40 fits tightly within the recess 43, as shown in FIG. 2.

The ribs 34 are clearly shown in FIGS. 7 through 9, which extend parallel to the longitudinal axis of the tube and support the shoulder 15 at the top edge 48, while being heat-sealed to the disc 44 at the bottom edge 50. In addition, it should be noted that the peripheral edge of the disc 44 is inserted in the recesses 52 of the head portion, as well as the recesses 54 of the neck portion of the dispensing tube. Thus, the disc 54 is heat-sealed at both its inner and outer perimeters, as well as on the top portion to said reinforcing ribs 34. The reinforcing ribs which extend from the neck part to said flange 40 form together with the shoulder 15 and disc 44 a plurality of separate chambers. FIG. 7 shows the barrier member disc 44 in the unassembled condition, while FIG. 8 shows the barrier member 44 both unassembled and assembled into the head portion of a dispensing container.

It will be noted that the cap 38 is screw-threaded on the extension 36 of the neck portion 28 and is provided with a recess **38*a* in the top thereof. Consequently, as shown in FIG. 10, when the tubes are stacked in superposed relationship, a downwardly directed extension 28*a* of the neck portion 28 will be seated within the recess 38*a* of the cap 38 on the next lower tubular container, whereby the recess will function as a stop member to separate the tubes and thereby prevent the sticking of the tubes to each other during denesting of the stack. As shown in FIG. 6** a gap is formed between adjacent tube bodies to permit separation of the stacked tubes and to also prevent scoring of the outside surfaces of said tubes.

It should be apparent that there is substantial savings in the use of the present barrier member over the known urea or other types of plastic inserts. Furthermore, it should be evident that the present invention is not intended to be limited to the embodiments shown and described, but that the invention may be modified in a manner to fall within the scope of the appended claims.

What is claimed is:

1. A collapsible container having a tubular body, a conical-shaped head portion affixed to one end thereof provided with a sloping shoulder portion and a peripheral flange portion, said flange portion extending parallel to the longitudinal axis of said tubular body and having a circumferential groove on an interior surface of said peripheral flange, a neck part provided with a threaded portion, a plurality of ribs extending parallel to the longitudinal axis of said tubular body and having the top edges thereof supporting said shoulder portion, a relatively thin, wafer-like apertured disc barrier member being supported and sealed in said head portion by said groove of said flange at said outer peripheral edge of said disc and by said neck part at the inner peripheral edge of said disc, said bottom edges of said ribs being secured to the top surface of said disc, said neck part having a substantially central opening therein in communication with said tubular body, and said ribs extending laterally from said neck part to said flange portion and acting to strengthen the end of said collapsible tube having said head portion affixed thereto, while additionally supporting said barrier member, whereby a plurality of separate chambers are formed.

2. A collapsible container as claimed in claim 1 further comprising an extension on said neck part directed away from said head portion and a screw-threaded cap adapted to be screwed on the threaded section of said neck part.

3. A collapsible container as claimed in claim 1 wherein said barrier member is a circular disc of aluminum foil ply.

* * * * *